United States Patent [19]

Moebius

[11] 4,132,187

[45] Jan. 2, 1979

[54] MANUAL DEVICE FOR INDICATING SCORES

[76] Inventor: Ulrich Moebius, Fraunhoferstrasse 45, D-6450 Hanau, Main, Germany

[21] Appl. No.: 830,851

[22] Filed: Sep. 6, 1977

[30] Foreign Application Priority Data

Jan. 12, 1977 [DE] Fed. Rep. of Germany ... 770068[U]

[51] Int. Cl.[2] ..... A63B 71/06

[52] U.S. Cl. ..... 116/225; 40/491

[58] Field of Search ..... 116/120, 135; 40/64 R, 40/65, 109, 110

[56] References Cited

U.S. PATENT DOCUMENTS

| | | | |
|---|---|---|---|
| 546,959 | 9/1895 | Larzelere | 116/120 |
| 1,007,760 | 11/1911 | Williams | 40/110 |
| 2,168,743 | 8/1939 | Paul | 116/120 |
| 2,264,516 | 12/1941 | Fisher | 40/110 |
| 2,787,068 | 4/1957 | Anspach | 116/135 |
| 2,879,614 | 3/1959 | Baldanza | 116/135 |

FOREIGN PATENT DOCUMENTS

| | | | |
|---|---|---|---|
| 463648 | 4/1937 | United Kingdom | 116/120 |

*Primary Examiner*—S. Clement Swisher
*Assistant Examiner*—Denis E. Corr
*Attorney, Agent, or Firm*—Dennison, Dennison, Meserole & Pollack

[57] ABSTRACT

A handsized scoring device for sporting events and particularly tennis having side and bottom recesses within which a magnifying indicator slide may travel over fixed score indicia on the device. Individual game scores are kept for several players on the upper area of the device and total game tally on the lower area. Provision is made for attachment of a supplemental score panel as well as a writing implement and pad of paper.

9 Claims, 2 Drawing Figures

MANUAL DEVICE FOR INDICATING SCORES

Figure 1:
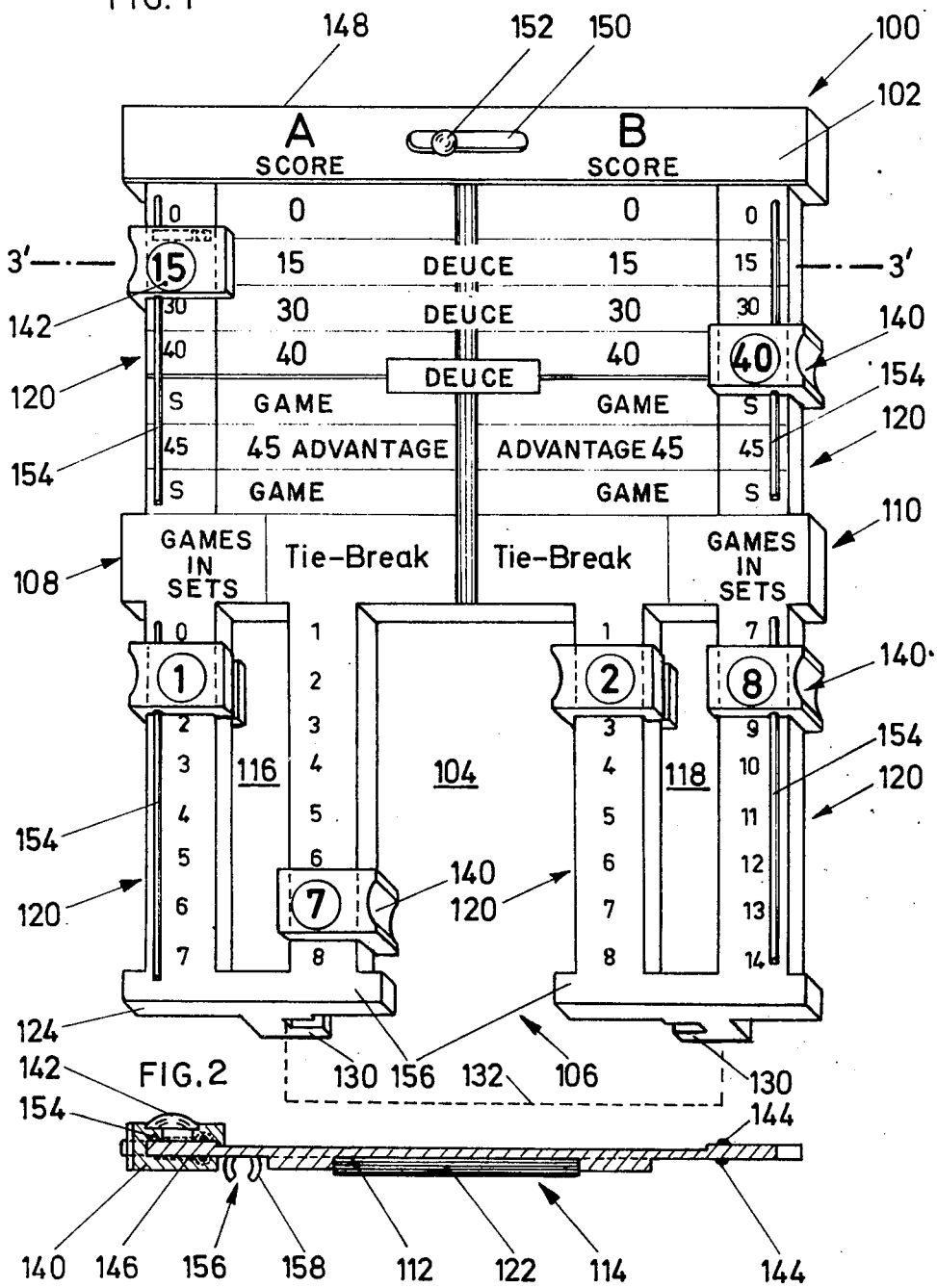

This invention relates to a manual device for indicating the scores of sports or games of all types, specifically tennis games.

Many sports necessitate complicated recording processes for the players and spectators as well as for the judges in order to record a score according to the rules. In tennis, ping-pong, golf and similar sports, it is vital to record the score of the play accurately and in addition thereto to give the participating players an opportunity for quickly finding out the score. Very often the course of the game and thus the respective score is recorded in writing on prepared boards, and usually on ordinary sheets of paper. However, this procedure requires a scorer not directly participating in the game who is not always available for private games. In rainy weather, one is also confronted with the disadvantage that the writing will be smeared or that the score sheets will get soaked.

In golf, each player is given a card on which he enters the number of strokes taken, however the entry will be made only after the completion of a hole. Since the interval of time between the teeshot and the successful holing out very often is rather considerable and the number of strokes is frequently not remembered, it often happens that an incorrect number of strokes is unintentionally recorded.

It is an object of this invention to furnish a device for the recording, indicating, or, respectively, accumulating of scores, by means of which the scores are recorded without actually writing them down on paper.

It is another object of the invention to provide a simple indicating device that can be used repeatedly without necessitating any writing material, by means of which the score of a game can be referred to and which precludes any miscounting as well as an unintended changing of the score.

It is a further object of the invention to furnish a simple device of light weight that can be carried and held in one hand, and on which the respective score can be set quickly and without any effort with the same hand or with the other one.

It is an additional object of the invention to provide a device for the storing and indicating of scores, which gives a clear picture even of games requiring more extensive information on the scores.

Still another object of the invention is to develop a device for the recording and indicating of game scores, to which additional accessory information carriers can be quickly and easily attached if so required.

According to the invention, there is provided a rectangular plate-like face of synthetic material or metal which on at least one surface thereof contains information on the game scores and which is equipped with a plurality of movable marking elements that can be set to positions as specified by the information on the scores, in order to record the actual score of the game. This new plate can be handled easily even in small pocket size.

Basically, the rectangular plate has recesses or cutouts on three sides of different size. A large recess at the lower end is shaped like a "U" so that even if the device is of small size, there will be sufficiently long edge lines along the legs of the "U" on which markers can be arranged. These markers can be slides moving in the recesses. Preferably, the legs on each side of the first U-shaped recess have a width of one-fourth to one-third of the length of that side on which the first recess is located, and a length of one-fourth to one-half of the length of one of the adjacent sides.

Due to the arrangement of recesses as well as of the movable marking elements there is the advantage of an easy, accurate and quick recording of the respective score of the game. For example, with the apparatus according to the invention, the lateral marking positions arranged above the lower recess can be used to find out the score in a tennis game by indicating the points in a game. The marking positions within the area of the lower recess, for example, can be used to show the number of games won in a set when there is a margin of two games, or, respectively, at a set gain with tie-break.

If the second marking positions do not suffice when counting a theoretically endless game, then an additional accessory plate can be slidingly engaged in the area of the lower recess, in order to enlarge the counting area. For this purpose, there are provided two spaced-apart channels within the area of the legs.

In addition thereto, by laying down the rules of the game in the form of an easily controllable apparatus, the invention is an excellent learning aid for beginners in the respective sport.

Preferably the size of the apparatus according to the invention should be suitable for a hand-bag, or for pockets in a suit, a jacket or in pants, so that the players can keep the same even during a game without being handicapped thereby.

All features of the invention will follow from the claims. Further details, characteristics and advantages of the invention will be apparent upon consideration of the following description of a graphically represented embodiment thereof wherein:

FIG. 1 is a perspective view of a manual device according to the invention for indicating the intermediate score or the final score of a game of tennis; and FIG. 2 is a sectional view taken along line 3'—3' of the manual device as shown in FIG. 1.

In FIG. 1, there is shown a manual device 100 which may be of any size. Preferably a size is chosen corresponding to the size of pockets in a sports shirt so that the manual device 100, on the one hand, can be easily fit into such pocket whereby the set score of the game cannot be changed hereby, and on the other can be easily held in one hand. The embodiment shown serves to indicate the intermediate score or the final score of a tennis game. The manual device 100 consists of a flat rectangular plate 102 made of synthetic material or metal, having on its lower edge 106 a first rectangular recess 104, whereby the plate 102 is formed with two depending legs 116, 118, and having further second rectangular recesses 120 on the adjacent lateral edges 108, 110. Preferably the first recess 104 has a width corresponding to a third of the length of the lower edge 106, and a length corresponding likewise to approximately one third of one of the edges 108, 110 adjacent thereto. The size of the plate 102 itself does not exceed the mentioned pocket size, in order to enable easy storage even during a game.

The recesses 120 are arranged in such a manner that each recess on one edge must be coordinated with one recess on the immediately opposite edge. In the upper as well as in the lower area of the plate, this arrangement is repeated and it is obvious that there will result several of such areas of recesses 120, which can be marked with similar figures. The recesses 120 extend in a row along the edges 108, 110 of the plate 102 and along the inner and outer edges of the legs 116 and 118 providing a larger area in the form of a guide for movement thereon of one slide 140 each. By means of the slides 140 the score of the game can be indicated.

On the upper surface of the plate is arranged data on the scores of the game. For example, the upper portion of the plate is divided into two areas A and B situated symmetrically to a center axis of the plate 102. This unmarked center axis is designated in FIG. 1 by several parallel vertical lines. In each area rectangles are provided by transverse lines in which the information on the scores of the game, e.g. figures and words, are entered.

The positions of the marking elements of slides 140 in relation to the data as contained in the rectangles indicate the score of the game.

The slides 140 are formed as elongated parts of synthetic material and of U-shape section. The two legs of the slide surround the guides in the recesses 120. Springs 146 may be mounted in the slides 140, cooperating with a plurality of projecting pips 144 provided for at the respective positions in such a manner that the slides will automatically stop in each position to which they are moved. Corresponding to these positions are the above explained rectangles or, respectively, figures and words arranged along the guide-way. Thus the slides 140 will assume the function of marking elements. For a better reading of the figure arranged in each position beneath the slide 140 and indicating the score of the game, each slide 140 is provided with an optical magnifying bubble 142, which can be formed as a lentiform boss of the slide being made of a transparent synthetic material.

For best handling and easy reading of an intermediate score or final score of a game, the face is subdivided into the two areas A and B, which are assigned to different players or pairs of players. In the upper portion of the plate 102, along the edges 108, 110, there are seven positions to which there are coordinated the point numbers 0, 15, 30, 40 as well as the designations "game", "45 advantage" and "game". These figures and expressions are familiar in tennis rules. Between the figures there is also indicated the technical term which an umpire will use when an equal number of scores is reached. The positions coordinated with the point number 0, 15, 30, 40 or, respectively "45 advantage", can be marked in red or other special color for clearness, whereas the recesses for "game" can be marked in blue if desired. This means that a marking element in a red position will show that a game is not yet settled, whereas a marking element in a blue position indicates the end of a game.

In the area of the legs 116, 118, on their lateral and inner surfaces, there are likewise arranged positions being suitable for the movement of marking elements or slides. In this area, the positions serve to indicate the score of the games in a set. For this purpose, the recesses 120 along the edges 108 and 110 are used to indicate the games won by the player A or B, respectively, if a set is decided by at least six won games and two games more than the opponent. The positions on the inner surfaces of the legs 116 and 118 can be used either to continue the counting of the game on the outer surfaces, which can be indicated by a sequence of numbers (not shown), e.g. 8 to 14, or they can be used for marking purposes when the game is played in the manner of "tie-breaks". In order to distinguish between the different types of games, there can additionally be provided a green or, respectively, black coloring within the range of the respective positions.

When the game is played without any "tie-break", it is very likely that a set can be decided only, when more than a difference of two games has been won. However, this means that the positions on the inner and outer edges will not suffice. In order to overcome this deficiency, receiving channels 130 are provided within the legs 116, 118 and parallel to the latter on the rear lower surface 124 of the plate 102. In the channels 130 a further score plate 132, which can be written on can be slideably mounted. It is obvious that by means of this score plate 132 the scoring for a game-type without "tie-break" can be continued at random. The score plate 132 can either be completely removed from the channels 130 or can be slid into the area above the recess 104, thus being protected by the upper portion of the plate 102 when it is not being used.

Instead of the channels 130 and a score plate 132, another arrangement can be used by means of which there can be indicated the names of the players, the set numbers and the scores of the sets. This arrangement comprises a groove or cut out 112 of rectangular configuration, provided in the rear face of the plate in the upper area of the same. In this recess 112 there is inserted a pad 114 composed of several sheets of paper 122. The rear sheet of the pad 114, e.g. can be glued into the recess 112, either on its entire surface or partially. It is likely possible to fix the pad 114, of which the sheets 122 can be torn off, in the recess by means of an elastic clip (not shown).

In order to make the notes on the sheets 122, customary writing implements can be used. A writing tool convenient in operation is e.g. a thin China-Riter. For a mounting support of such a China-Riter, a bracket-like support 156 can be provided on the rear of the plate 102, being composed of two curved spring projections 158. Due to the elastic property of the plastic material of the plate 102, the projections 158 will yield whenever the China-Riter is put in or removed.

Close to the upper edge 148 of the plate 102 there is an elongated recess 150 running transversely to the edge 148. In this recess 150 there is a button 152 having a pin-like shaft being movably mounted. The ends of the recess 150 are located on both sides of the axis of symmetry, dividing the upper portion of the plate 102 into two equal halves. According to the position of the button 152, either in the right or left half, it can be indicated which of the players has the service.

Along the guides of the plate 102 there can be arranged rails 154, projecting into corresponding recesses of the slides 140. These rails 154 serve to guide the slides 140. They do, however, serve an additional purpose. The slides 140 with their recesses are retained on the rails 154. Thereby they are protected from falling off the plate 102.

The lower extremities of the legs 116, 118 can also be closed off if desired. In this manner, an increased stiffness can be obtained if the thickness of the plate 102 is rather small.

I claim:

1. A hand-sized scoring indicator for sports events and particularly tennis, including a plate having opposed front and rear faces, opposed side edges, and opposed upper and lower edges, said plate having upper and lower areas, said lower area including a pair of laterally space legs defined in part by recess means therebetween, each leg having an outer edge defined by one of said opposed side edges, and each leg having an inner edge, score indicia provided on said front face along said opposed side edges in both the upper area and the lower area, and along the inner edge of each leg, and marking slides mounted on and movable along each of said opposed side edges and each of said inner edges for selective alignment with the score indicia.

2. A scoring indicator as defined in claim 1, wherein each marking slide is of U-shaped configuration and straddles the corresponding edge of said plate.

3. A scoring indicator as defined in claim 1 wherein each of said opposed side edges includes a pair of spaced elongated recesses defined therein, one of said elongated recesses being generally coextensive with said upper area and one of said elongated recesses being generally coextensive with said lower area, one of said marking slides being mounted in each of said elongated recesses.

4. A scoring indicator as defined in claim 2 including a plurality of spaced stop members arranged along said plate edges and spaced inwardly thereof and means within each slide releasably engageable with said stop members.

5. A scoring indicator as defined in claim 2 wherein each of said opposed side edges includes a pair of spaced elongated recesses defined therein, one of said elongated recesses being generally coextensive with said upper area and one of said elongated recesses being generally coextensive with said lower area, one of said marking slides being mounted in each of said elongated recesses.

6. A scoring indicator as defined in claim 4 and further including a rail member along each edge of said plate on which marking slides are movable, and a groove in each slide to receive said rail for guided movement of the slide along the rail.

7. A scoring indicator as defined in claim 6 and further including a division line generally paralleling the opposed side edges centrally therebetween and separating the face of said plate into two player halves, and an elongated slot extending across the top of said plate and spanning a portion of each player half, and a pin member slideable in said slot to indicate a particular player.

8. A scoring indicator as defined in claim 7 and further including a recess on the rear face of said plate for the reception of a rearwardly facing pad of paper.

9. A scoring indicator as defined in claim 7 wherein each of said opposed side edges includes a pair of spaced elongated recesses defined therein, one of said elongated recesses being generally coextensive with said upper area and one of said elongated recesses being generally coextensive with said lower area, one of said marking slides being mounted in each of said elongated recesses.

* * * * *